US006049929A

United States Patent [19]

Rawson

[11] Patent Number: 6,049,929

[45] **Date of Patent: *Apr. 18, 2000**

[54] SEATING SYSTEM FOR INFANTS AND BABIES

[76] Inventor: Terilyn Jo Rawson, 2550 Centinela Ave. #110, Los Angeles, Calif. 90064

[ * ] Notice: This patent issued on a continued prosecution application filed under 37 CFR 1.53(d), and is subject to the twenty year patent term provisions of 35 U.S.C. 154(a)(2).

[21] Appl. No.: 09/088,574

[22] Filed: Jun. 2, 1998

[51] Int. Cl.[7] ..... A47D 13/00

[52] U.S. Cl. ..... 5/655; 297/181; 297/464; 297/467

[58] Field of Search ..... 297/181, 467, 297/DIG. 6, 464; 5/655, 922

[56] References Cited

U.S. PATENT DOCUMENTS

| | | | |
|---|---|---|---|
| 1,769,722 | 7/1930 | Sutton . | |
| 2,736,364 | 2/1956 | Janus . | |
| 3,840,916 | 10/1974 | Jennings | 5/655 |
| 4,441,221 | 4/1984 | Enste et al. | 5/655 X |
| 4,568,125 | 2/1986 | Sckolnik | 297/467 |
| 4,586,747 | 5/1986 | Taylor . | |
| 4,871,210 | 10/1989 | Alexander et al. | 297/467 X |
| 4,909,573 | 3/1990 | Barry et al. . | |
| 5,193,238 | 3/1993 | Clute | 5/655 |
| 5,347,669 | 9/1994 | Neviaser et al. | 5/655 |
| 5,367,730 | 11/1994 | Sher | 5/655 |
| 5,551,749 | 9/1996 | Reher et al. . | |
| 5,687,433 | 11/1997 | Garner et al. | 297/467 X |

*Primary Examiner*—Peter R. Brown
*Attorney, Agent, or Firm*—Evanns & Walsh; Joseph R. Evanns

[57] ABSTRACT

An infant and baby seating system comprises a first closure element, second closure element, and connector therebetween detachably fastenable to connect the first closure element and the second closure element, the distance between the two closure elements being adjustable to the size of the user. Securement members may be fastened between the closure elements.

20 Claims, 2 Drawing Sheets

SEATING SYSTEM FOR INFANTS AND BABIES

1. Field of the Invention

The invention relates to a system for seating infants and young babies and for fostering learning to do so.

2. Description of Existing Devices

The needs of children, particularly infants and babies, are always of great importance for parents. Experiences and events at the earliest stages may greatly influence and affect physical, emotional, and mental development of the child. Recent studies have indicated that for child development, early sitting may be of potential value.

Existing devices for seating of infants and babies include the device disclosed in U.S. Pat. No. 5,551,749 (Reher et al) which discloses a baby seat with inner support structure including backrest and base and having a removable cushion assembly affixable over the base structure.

U.S. Pat. No. 1,769,722 (Sutton) discloses a seat for supporting an infant in a sitting position including a base, a body confining element, a back portion and side arms. A restraint strap is also provided.

Existing devices do not make provision for relatively free and reasonably extended movement of the sitting baby using the devices. These factors are believed to be of importance with respect to learning and benefits of sitting relative to early child development.

Therefore, there has been a felt but unfulfilled need for a seating system for infants and young babies which allows relatively extended and free movement which may assist in development of spatial awareness and balance while affording the capability of retention of the user.

SUMMARY OF THE INVENTION

An infant and baby seating system comprises a first closure element, second closure element, and connector means therebetween detachably fastenable to connect the first closure element and the second closure element. The distance between the two seating elements may be adjustable to the size of the user.

DETAILED DESCRIPTION OF THE INVENTION

Figure 1:
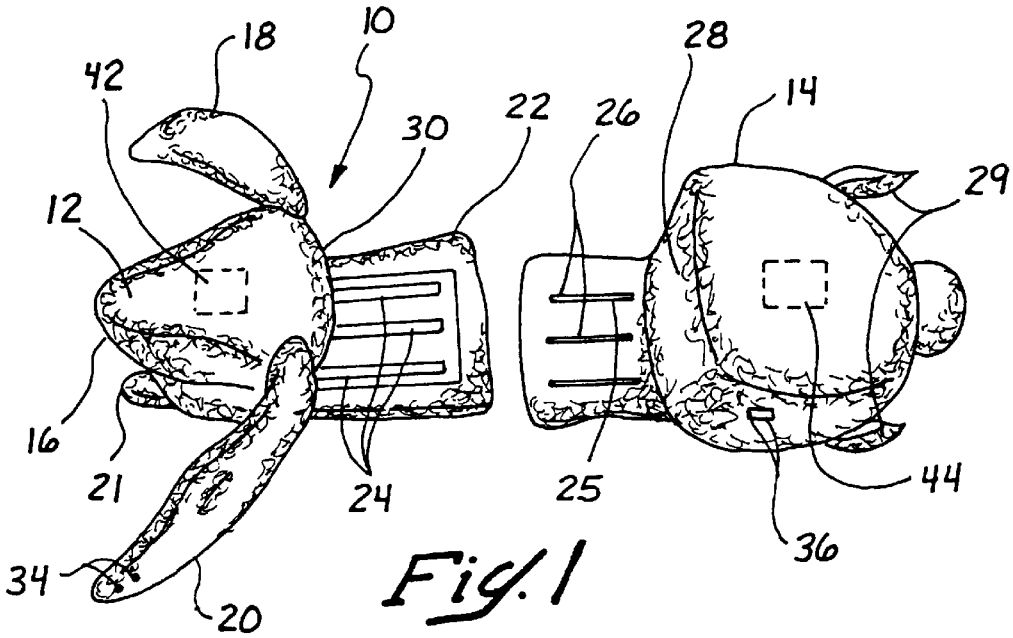
FIG. 1 is a perspective top view of a seating system for accommodating a sitting baby in accordance with the invention in a disassembled condition.
Figure 2:
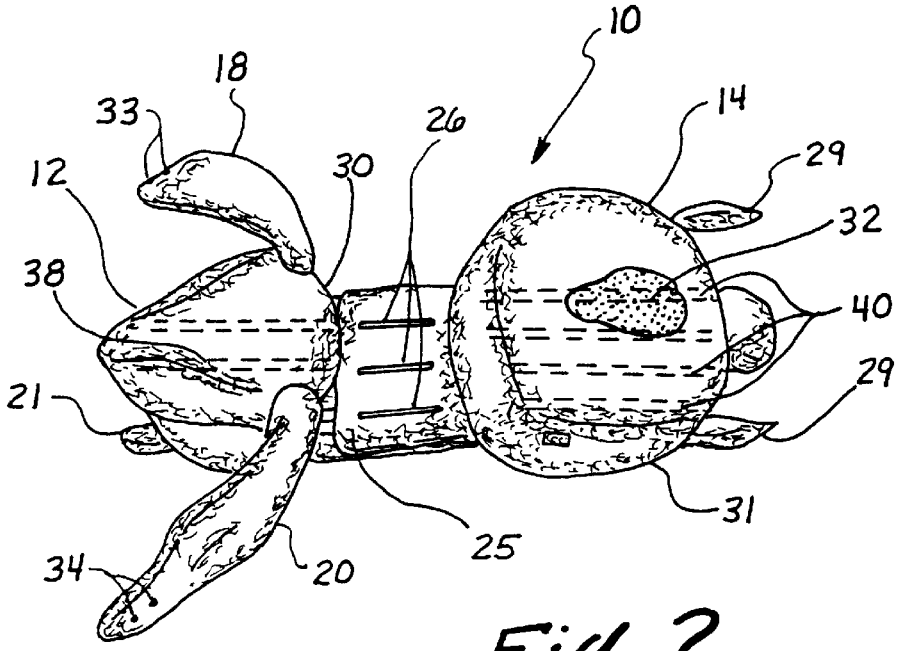
FIG. 2 is a perspective top view of the structure depicted in FIG. 1, in an assembled condition, partly broken away.
Figure 3:
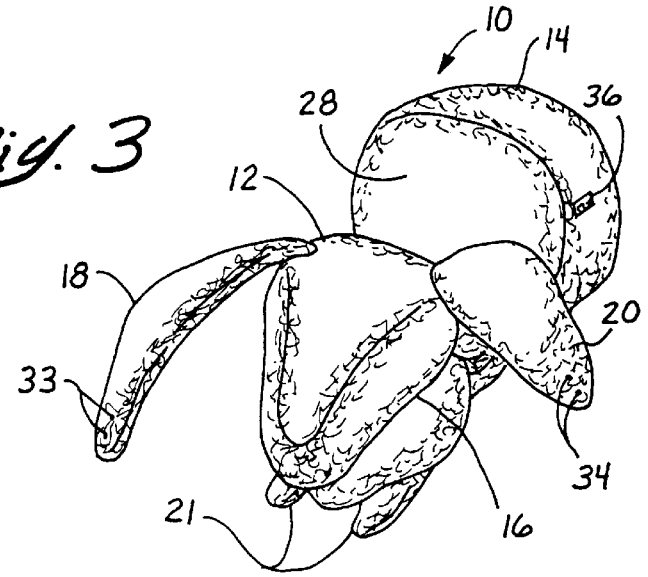
FIG. 3 is a top anterior view of a structure in accordance with the invention in assembled condition.
Figure 4:
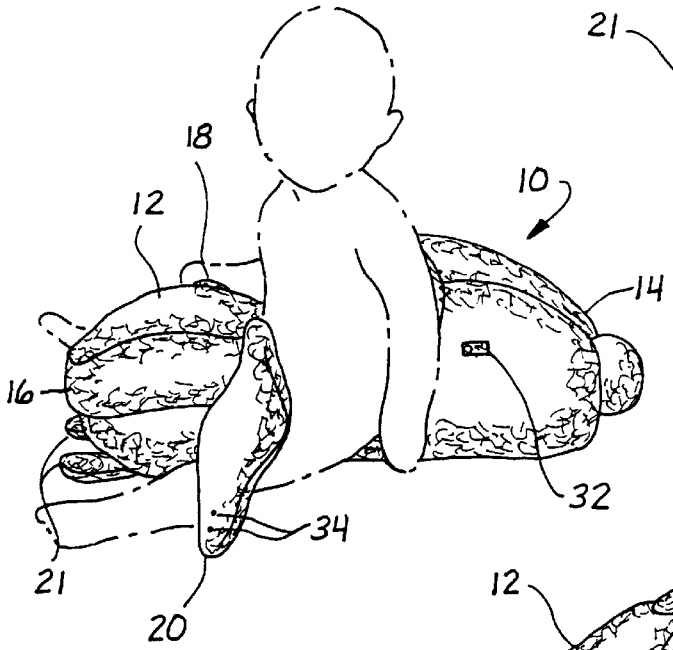
FIG. 4 is a perspective view of a structure in accordance with the invention including a sitting baby therein.
Figure 5:
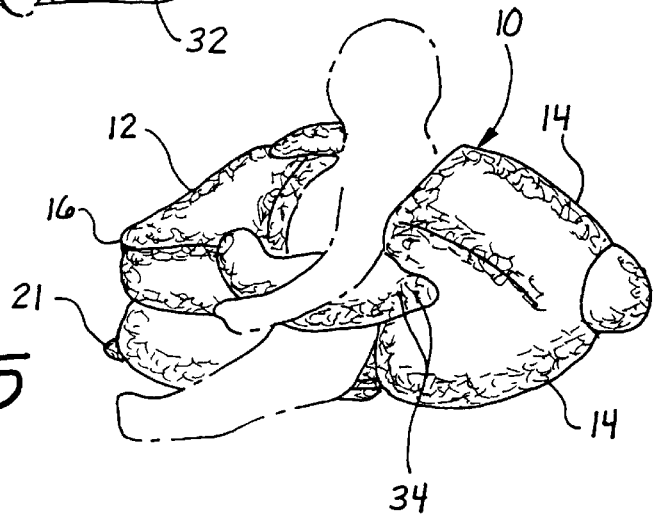
FIG. 5 is a side view of a structure in accordance with the invention with a baby sitting therein.

As depicted in FIGS. 1–5 inclusive, a seating system 10 for an infant or young baby comprises a first closure element in the form of an anterior member 12 and a second closure element in the form of a posterior member 14. Anterior member 12 comprises in the depicted embodiment a simulated head 16 of an animal. Retention means 18, 20 in the form of a pair of simulated ears are affixed to head 16.

At the bottom of anterior member 12 are simulated legs 20 disposed under the simulated head 16 such that an impression of a crouching or resting animal is conveyed.

A first connector element in the form of an anterior connector member 22 is secured at its anterior end to anterior member 12.

Disposed upon connector 22 are securement elements 24 depicted as a plurality of strips of retentive material such as is sold under the brand name VELCRO.

Attached to an anterior lower portion of member 14 is a second connector element in the form of a posterior connector member 25, upon which are disposed securement elements 26 in the form of a plurality of strips of material such as the VELCRO strips comprising securement elements 24.

Member 14 as depicted is configured in the form of hindquarters of an animal including simulated rear legs 29 attached to the rear of member 14. As set forth in farther detail below, simulated legs 21, 29 may be employed for stabilization in addition to enhancing the impression of a simulated resting animal At the anterior end of member 14 is a back rest surface 28, preferably somewhat convex in order to urge a sitting user slightly forward which is believed to aid in the development of sitting and balance skills.

At the posterior end of anterior member 12 is a support surface 30.

Members 12, 14 are composed of formed fabric 31 containing stuffing material 32 of conventional type. In this manner, a stable and comfortable structure is provided.

Connectors 22, 25 may be sewn onto members 12, 14, respectively, or they may be integral therewith.

Securement members 18, 20 in the form of a pair of ears extend from simulated animal head 16 of anterior member 12. Flexible enclosure of the user is accomplished by means of fastening securement members 18, 20, respectively, to posterior member 14. For this purpose, pairs of eyes 33, 34 are defined at the outer ends of securement members 18, 20, respectively. Correspondingly, a pair of hooks 36 are disposed within the lateral periphery of member 14. In order to secure the user within the structure, the user is placed between the anterior member 12 and the posterior member 14, and the securement members 18, 20 are fastened by their respective eyes 33, 34 to the corresponding hooks 36 (shown only for securement member 20).

The configuration of system 10 together with its individual components is such that the structure is adapted for use on a flat surface such as a floor. The latter has been found to be particularly convenient and appropriate for seating systems in accordance with the invention.

In operation, anterior member 12 and posterior member 14 are placed at an interval apart so as to fit the particular user of the system 10. Connectors 22, 25 are then secured to one another and the child is then in place between anterior member 12, and posterior member 14. Securement members 18, 20 are then secured to anterior member 14. The baby is then comfortably seated with substantial maneuvering space.

The invention is usable as an aid to early child development with respect to balance and sitting. In this mode, system 10 preferably will be capable of gentle lateral displacement resulting from sufficient sideways motion by the user. Such motion and result are believed to foster sitting and balance skills in early development. Under such conditions, prevention of possibly injurious backward and forward falling is accomplished by system 10 while allowing gentle lateral displacement. For such operation, system 10 does not require substantial added lateral stabilization For a baby who has progressed in sitting/balance skills, system 10 may be employed to emphasize retention (as opposed to training in sitting/balance) by providing stabilization against lateral displacement.

System 10 may be weighted and, or in the alternative, may be equipped with means such as VELCRO strips 38, 40 in anterior member 12 and posterior member 14, respectively to secure to a surface, such as a carpet, upon which system 10 is disposed. Weighting may be provided by weights 42,44 in anterior member 12 and posterior member 14, respectively.

Weighting may be provided preferably at or adjacent base area of system 10 by securing weights in connection with members 12,14,21,22,25,29 or a combination of same.

In this manner, an improved flexible enclosure for accommodating a sitting baby is provided, affording freedom of motion, upright posture, and security.

Though a particular embodiment has been described and depicted herein, the invention is defined solely by the appended claims interpreted in light of the specification and drawings.

What is claimed is:

1. A seating system for flexible seating of infants and babies in a generally upright position substantially at floor level comprising:

(a) first relatively soft closure means positionable substantially at floor level for forward support of a seated user and to substantially prevent forward falling by a seated user, said first closure means being configured to be straddleable by the legs of a seated user;

(b) second relatively soft closure means positionable substantially at floor level for rearward support of a seated user and to substantially prevent rearward falling by a seated user;

(c) connector means for detachably connecting said first closure means and said second closure means such as to be separated from each other at any selected distance to form at least a partial closure having said selected length substantially preventing forward and backward falling while allowing lateral motion to the extent of falling sideways onto the floor for said user for promoting acquisition of balance skills said connector means including at least a portion thereof for accommodating sitting thereon by said user.

2. The invention as set forth in claim 1 further including securement means secureable between said first closure means and said second closure means to form lateral closure for said user.

3. The invention as set forth in claim 2 wherein said first closure means comprises a simulated animal head, and said second closure means comprises simulated animal hindquarters.

4. The invention as set forth in claim 3 wherein said securement means comprises a pair of simulated ears disposed upon said first closure means.

5. The invention as set forth in claim 4 wherein said securement means includes at least one eye on each of said simulated ears and further includes at least one hook disposed on said second closure means for fastening engagement with said at least one eye.

6. The invention as set forth in claim 1 wherein said first closure means comprises an anterior member positionable forwardly of said user.

7. The invention as set forth in claim 1 wherein said second closure means comprises a posterior member having a backrest section for placement adjacent the back of the user.

8. The invention as set forth in claim 7 wherein said backrest section is at least partially configured with a substantially convex contour.

9. The invention as set forth in claim 1 wherein said connector means comprises a first connector member and a second connector member.

10. The invention as said forth in claim 9 wherein said first connector member and said second connector member each include at least one securing means for securing together said first connector member and said second connector member.

11. The invention as set forth in claim 9, wherein said first connector member and said second connector member are connectable to provide adjustable distance between said first closure means and said second closure means for accommodating users of different sizes.

12. The invention as set forth in claim 1 wherein said first closure means, said second closure means, and said connector means are substantially flat at the bottom thereof for placement thereof upon a substantially flat surface such as a floor.

13. The invention as set forth in claim 1 wherein said first closure means and said second closure means comprise fabric containing stuffing.

14. The invention as set forth in claim 1 wherein said first closure means and said second closure element are connectable to said connector means such as to be positionable at adjustable distances from one another to accommodate users of different sizes.

15. The invention as set forth in claim 1 further including retention means for retention of the user.

16. The invention as set forth in claim 15 wherein said retention means comprises weight means for weighting of at least said first closure means.

17. The invention as set forth in claim 15 wherein said retention means comprises weight means for weighting in connection with at least said second closure means.

18. The invention as set forth in claim 15 wherein said retention means comprises weight means for weighting of with at least said connector means.

19. The invention as set forth in claim 15 wherein said retention means comprises means on at least one of said first closure means, said second closure means, and said connector means for adhering to a surface upon which said system is disposed.

20. The invention set forth in claim 1 further including lateral stabilizing means.

* * * * *